US006533410B1

(12) United States Patent
Shefler et al.

(10) Patent No.: US 6,533,410 B1
(45) Date of Patent: Mar. 18, 2003

(54) ALL OPTICAL NEEDS

(76) Inventors: Don N. Shefler, 2440 Domingo St., Las Vegas, NV (US) 89121; Scott Flynn, 448 Elysian Plains Ct., Las Vegas, NV (US) 89145

( * ) Notice: Subject to any disclaimer, the term of this patent is extended or adjusted under 35 U.S.C. 154(b) by 0 days.

(21) Appl. No.: 10/171,363

(22) Filed: Jun. 14, 2002

(51) Int. Cl.[7] ..... G02C 13/00; G02C 1/00
(52) U.S. Cl. ..... 351/42; 351/41; 206/5
(58) Field of Search ..... 351/42, 41, 111, 351/158; 206/5, 6, 6.1

(56) References Cited

U.S. PATENT DOCUMENTS 5,921,383 A * 7/1999 Shefler et al. ..... 206/5
6,286,954 B1 * 9/2001 Mechlin ..... 351/111
6,305,798 B1 * 10/2001 Whisenant ..... 351/111

* cited by examiner

*Primary Examiner*—Hung Xuan Dang
(74) *Attorney, Agent, or Firm*—Leonard Weiss

(57) ABSTRACT

A folder has rectangular walls that have a length and width that are approximately the same as the length and width of a credit card. An interior surface of one of the walls has a mirrored surface. Nested within an interior surface of the other wall are a screw driver, a magnifying glass, a cleaning fluid container and a tube with hinge screws therein. Additionally, a pair of nose pads are adhesively connected to the other wall.

4 Claims, 2 Drawing Sheets

ALL OPTICAL NEEDS

BACKGROUND OF THE INVENTION

1. Field of Invention

This invention is in the general field of optometry and, more particularly, is a kit for repairing and maintaining eyeglasses.

2. Description of the Prior Art

A frame of eyeglasses includes a front rim which holds a lens for each of a wearer's eyes. A left and a right temple arm of the frame is attached to a left and a right outer side, respectively, of the rim. When the rim is positioned with the lenses in front of the wearer's eyes, the left and right temple arms rest on the left and right ears, respectively of the wearer and the frame may rest upon the wearer's face.

Each temple arm is attached to the rim by a hinged connection whereby the temple arms swing approximately ninety degrees from their open position to a closed position. The regular swinging of the temple arms when the frame is handled as well as normal use, and sometimes misuse, of the eyeglasses puts a strain on the hinged connections. Because of the strain, screws of the hinged connection become loose and are frequently lost.

When the frame irritates the wearer's face, a nose pad is connected to each nose piece of the frame, thereby causing a separation of the rim from the wearer's face.

The nose pad typically has an adhesive on one side that is used to adhesively connect it to the nose piece.

Even when replacement of the lost screws and the nose pads, is available, they are of a small size that makes their installation difficult. Accordingly, there is a need for tools especially suited for installation of the screws and the nose pads. Additionally, there is a need for a kit wherein the replacement screws, nose pads and tools for their installation are available.

SUMMARY OF THE INVENTION

According to the present invention, a folder has one wall with an interior surface that is a mirror and another wall has an interior surface that provides seating for a magnifying glass and a screwdriver. The envelope additionally provides seating for a nose pad, a hinge screw container and a leaning fluid container. When the foldrer is closed, a polishing cloth is retainable between the walls.

DESCRIPTION OF THE PREFERRED EMBODIMENT

Figure 1:
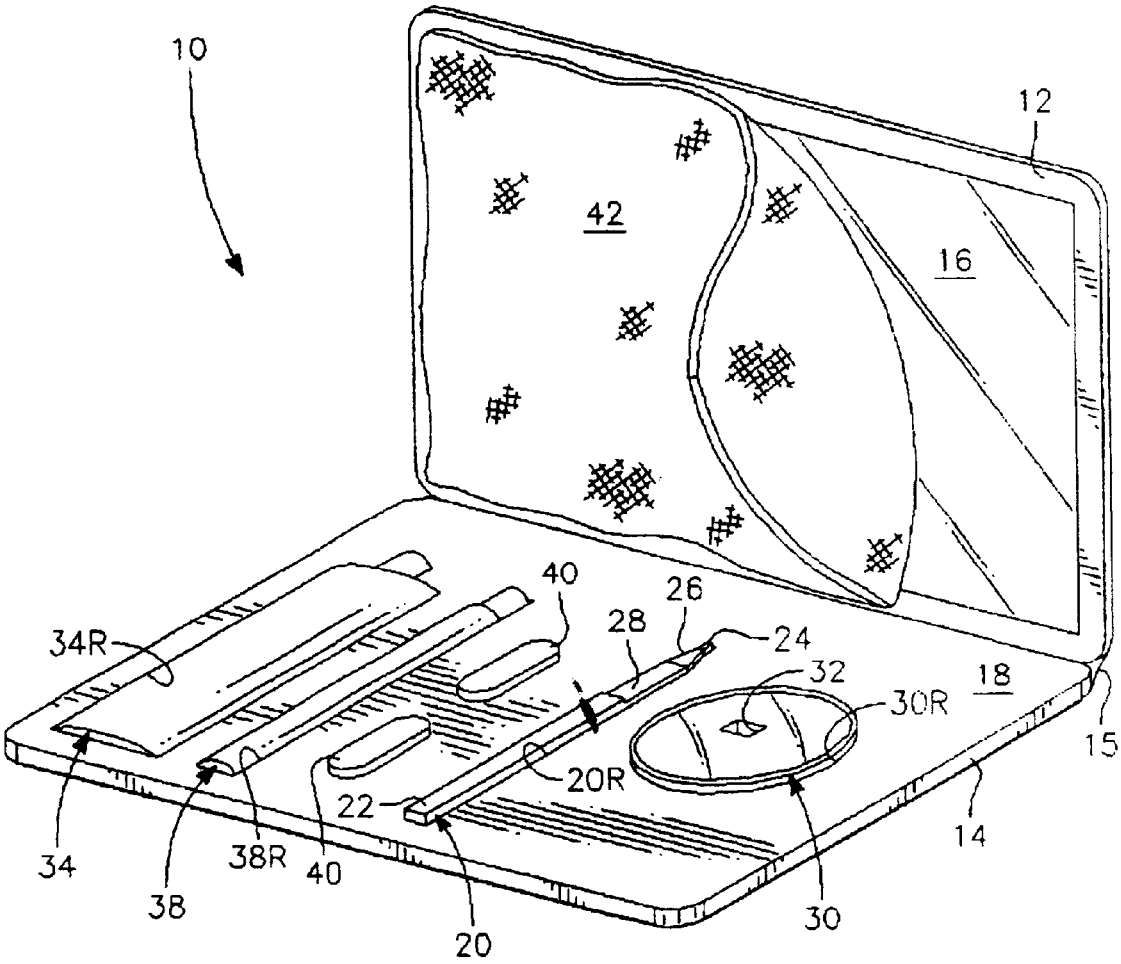
FIG. 1 is a perspective view of the interior of an envelope where contents of a kit are seated.
Figure 2:
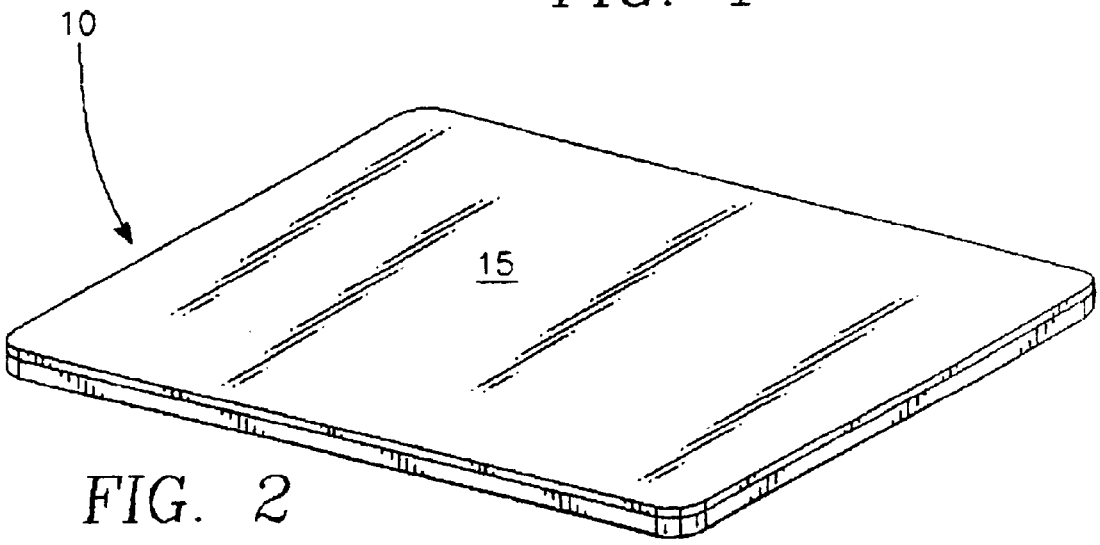
FIG. 2 is a perspective view of the envelope of FIG. 1 when it is closed.

As shown in FIGS. 1 and 2, an eyeglass care kit is maintained within a folder 10 that has rectangular walls 12, 14 that have a length and a width that are approximately the same as the length and width of a credit card. A vinyl covering 15 covers an exterior face of the wall 12 and an exterior face of the wall 14. Additionally, the covering 15 connects the wall 12 to the wall 15. Because vinyl is pliable, the folder 10 is easily opened (FIG. 1) and closed (FIG. 2).

The wall 12 has a mirrored interior face 14. Typically, the mirrored face 14 is used when a person wants to make an adjustment to a pair of eyeglasses (not shown) while wearing the eyeglasses.

A screwdriver 20 that has a shank 22 is removably nested within a recess 20R in the face 18. A blade 24 extends from a wedge shaped end 26 of the shank 22. The end 26 is integrally connected to a lower part 28 of the shank 22. The part 28 has a rectangular cross section.

A magnifying glass 30 is removably nested within a recess 30R in the face 18. The recess 30R is proximal to the recess 20R. The magnifying glass has a central hole 32 therethrough with a shape that is complimentary to the cross section of the part 28.

Figure 3:
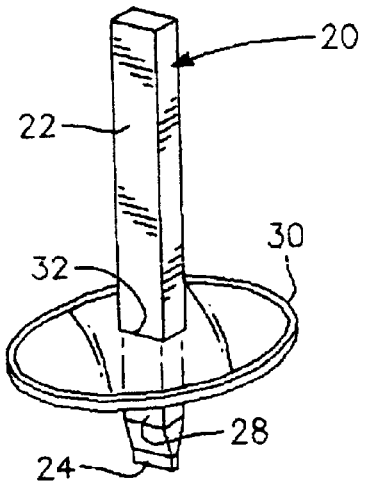
FIG. 3 is a perspective view of a screwdriver of FIG. 1 and a magnifying glass of FIG. 1 with the screwdriver's shank retained within a hole through the center of the magnifying glass.

As shown in FIG. 3, the part 28 fits snugly within the hole 32, thereby providing an enlarged view of a work area when, for example, the screwdriver 20 is used to install a hinge screw (not shown) to connect a temple (not shown) to a rim of a pair of eyeglasses (not shown). Preferably, the part 28 has a lengthwise taper (not shown) that maintains the snug fit.

A cleaning fluid bottle 34 is removably nested within a recess 34R in the face 18. The bottle 34 contains a fluid that is usable to clean a lens of the eyeglasses.

Figure 4:
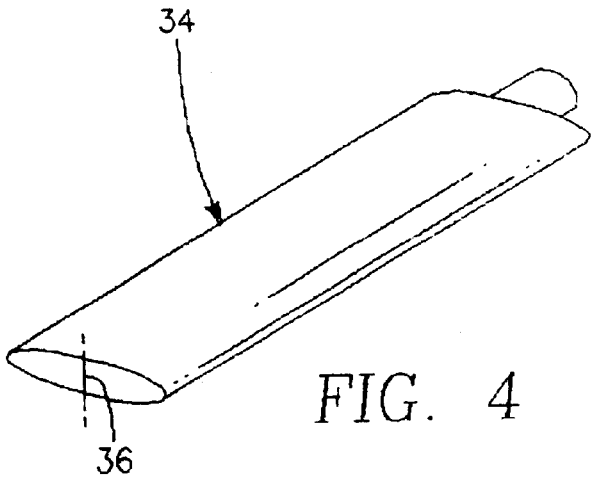
FIG. 4 is a perspective view of a cleaning fluid container.

As shown in FIG. 4, the bottle 34 has an elliptical cross section with a minor axis 36 of a size sufficiently small to obviate an unwanted bulge when the bottle 34 is nested the recess 34R and the folder 10 is closed.

A tube 38 (FIG. 1) is removably nested within a recess 38R in the face 18. Hinge screws of several different sizes are stored within the tube 38. The hinge screws provide a replacement of a hinge screw that may be lost. Additionally, a pair of nose pads 40 are adhesively maintained upon the face 18 for possible use in preventing frames of the eyeglasses from being an irritant. Also included in the kit is a polishing cloth 42 that is stored between the faces 16, 18.

Figure 5:
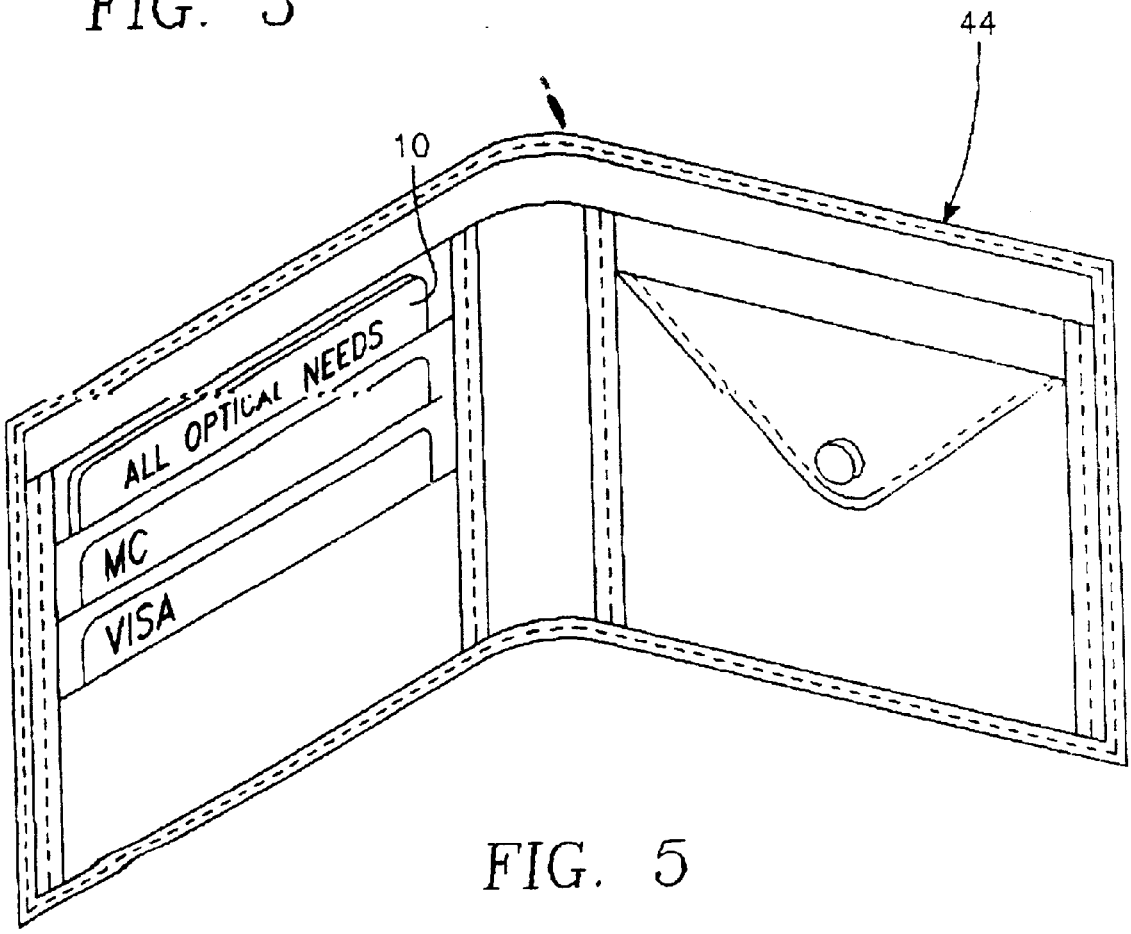
FIG. 5 is a perspective view of the closed envelope of FIG. 2 inserted into a wallet.

As shown in FIG. 5, the closed folder 10 is inserted into a wallet 44. The folder 10 may have printed information on its exterior for purposes of easy identification.

While the invention has been particularly shown and described with reference to a preferred embodiment, it should be understood by those skilled in the art that changes in form and detail may be made therein without departing from the spirit and scope of the invention.

We claim:

1. An eyeglass care kit comprising:

a screwdriver having a shank with a rectangular cross section;

a magnifying glass having a hole through its center, said hole having a shape that is substantially complimentary to the shape of said shank;

a first wall of a folder having an interior face with a recess wherein said screwdriver is removably nested and a recess wherein said magnifying glass is removably nested; and a second wall of said folder having a mirrored interior face;

a pliable covering of the outer faces of said walls that connects said walls together and permits opening and closing of said folder.

2. The kit of claim 1 wherein said covering is vinyl.

3. The kit of claim 1 additionally comprising:

a cleaning fluid bottle that is removably nested within a recess in said interior face of said first wall;

a tube for storing hinge screws that is removably nested within a recess in said interior face of said first wall; and a nose pad that is adhesively maintained upon the interior face of said first wall.

4. The kit of claim 3 wherein said cleaning fluid bottle has an elliptical cross section.

* * * * *

UNITED STATES PATENT AND TRADEMARK OFFICE
Certificate

Patent No. 6,533,410 B1 Patented: March 18, 2003

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Don N. Shefler, Las Vegas, NV.

Signed and Sealed this Twenty-first Day of October 2003.

HUNG XUAN DANG
*Acting Supervisory Patent Examiner*
Art Unit 2873